US008429765B2

(12) United States Patent
Africa et al.

(10) Patent No.: US 8,429,765 B2
(45) Date of Patent: Apr. 30, 2013

(54) BREATHEABLE PADDING FOR CYCLING GLOVES

(75) Inventors: Robert Africa, Boulder, CO (US); Don Powell, Boulder, CO (US); Paul Fair, Denver, CO (US)

(73) Assignee: DashAmerica, Inc., Louisville, CO (US)

( * ) Notice: Subject to any disclaimer, the term of this patent is extended or adjusted under 35 U.S.C. 154(b) by 967 days.

(21) Appl. No.: 11/070,582

(22) Filed: Mar. 1, 2005

(65) Prior Publication Data

US 2006/0195968 A1 Sep. 7, 2006

(51) Int. Cl.
*A41D 19/00* (2006.01)

(52) U.S. Cl.
USPC ..... 2/161.1; 2/160; 2/161.8; 2/164

(58) Field of Classification Search ..... 2/161.1, 2/162, 167, 159, 161.6, 164, 160, 161.8, 2/16; 428/116
See application file for complete search history.

(56) References Cited

U.S. PATENT DOCUMENTS

| | | | | | |
|---|---|---|---|---|---|
| 723,348 | A | * | 3/1903 | Wilkens | 2/164 |
| 2,465,136 | A | | 3/1949 | Troccoli | |
| 3,597,765 | A | | 8/1971 | Stanton | |
| 4,038,787 | A | | 8/1977 | Bianchi | |
| 4,270,228 | A | * | 6/1981 | Gaiser | 2/158 |
| 4,329,741 | A | | 5/1982 | Bach | |
| 4,485,568 | A | * | 12/1984 | Landi et al. | 36/44 |
| 4,559,646 | A | * | 12/1985 | Ertl | 2/16 |
| 4,691,387 | A | | 9/1987 | Lopez | |
| 4,788,972 | A | * | 12/1988 | DeBusk | 602/5 |
| 5,031,640 | A | | 7/1991 | Spitzer | |
| 5,271,101 | A | | 12/1993 | Speth et al. | |
| 5,274,846 | A | | 1/1994 | Kolsky | |
| 5,345,609 | A | | 9/1994 | Fabry et al. | |
| 5,365,610 | A | | 11/1994 | Lubahn et al. | |
| 5,390,372 | A | * | 2/1995 | Hashimoto et al. | 2/161.2 |
| 5,423,087 | A | | 6/1995 | Krent et al. | |
| 5,581,809 | A | | 12/1996 | Mah | |
| 5,598,582 | A | | 2/1997 | Andrews et al. | |
| 5,682,613 | A | * | 11/1997 | Dinatale | 2/168 |
| 5,749,111 | A | | 5/1998 | Pearce | |
| 5,790,980 | A | | 8/1998 | Yewer, Jr. | |
| 5,819,312 | A | | 10/1998 | Snyder et al. | |
| 5,896,580 | A | | 4/1999 | Aldrich et al. | |
| 5,926,847 | A | * | 7/1999 | Eibert | 2/161.2 |
| 5,987,642 | A | | 11/1999 | Webster | |
| 5,994,450 | A | | 11/1999 | Pearce | |
| 6,006,751 | A | | 12/1999 | Spitzer | |
| 6,026,527 | A | | 2/2000 | Pearce | |
| 6,154,885 | A | | 12/2000 | Kobayashi et al. | |
| 6,216,276 | B1 | | 4/2001 | Eibert | |
| 6,393,618 | B2 | | 5/2002 | Garneau | |
| 6,408,446 | B1 | | 6/2002 | Carrington | |
| 6,413,458 | B1 | | 7/2002 | Pearce | |
| 6,618,860 | B1 | * | 9/2003 | Sullivan et al. | 2/159 |
| 6,655,048 | B2 | * | 12/2003 | Moretti | 36/3 R |
| 6,797,765 | B2 | | 9/2004 | Pearce | |
| 6,832,391 | B1 | * | 12/2004 | Bower | 2/159 |
| 6,845,519 | B2 | * | 1/2005 | Garneau | 2/161.1 |

* cited by examiner

*Primary Examiner* — Shelley Self
*Assistant Examiner* — Richale L Quinn
(74) *Attorney, Agent, or Firm* — Sheridan Ross P.C.

(57) ABSTRACT

An athletic glove having at least one padded insert is provided. The padded insert comprises reticulated or open cell form, or a rubber formed into a matrix that allows ventilation paths.

5 Claims, 6 Drawing Sheets

BREATHEABLE PADDING FOR CYCLING GLOVES

FIELD OF THE INVENTION

The present invention relates to gloves and, more particularly, athletic gloves having palm located pads that are breathable and useful for gripping, for example, a handlebar of a bicycle.

BACKGROUND OF THE INVENTION

Athletic gloves, and particularly cycling gloves, of various configurations have become popular because they aid in gripping a handlebar of a bicycle, they are durable, they provide cushioning, they protect the hands of the cyclist, and they reduce abrasion to the hands of the cyclist. Many padded cycling gloves are currently available on the market. The following are some examples of padded cycling gloves, all of which are incorporated herein by reference as if set out in full.

U.S. Pat. No. 6,216,276, titled Padded Athletic Gloves, issued Apr. 17, 2001, describes a padded athletic glove wherein pre-formed, air blown, silicon foam pads are stitched on the glove, or are applied to the glove using adhesive. Cycling gloves are mentioned wherein protective padding is provided on the palm and/or fingers of the glove. Athletic gloves are described that protect the palms and/or fingers, that assist in caching a ball or the like, and that enhance the gripping of an object. Pads are described that range from about 0.010 inch to about 0.012 inch thick, having a durometer range of about 45 Shore A to about 55 Shore A, and having a specific gravity of about 1.12 to about 1.16.

U.S. Pat. No. 5,987,642,titled Protective Batting Glove, issued Nov. 23, 1999, describes a batting glove that includes shock-absorbing vinyl nitril pads (about 1/16 to 3/32 inch thick) that are glued to the glove and then covered by a thin layer of leather that is sewn to the glove.

U.S. Pat. Nos. 5,031,640, titled Pad for Preventing Carpal Tunnel Syndrome, issued Jul. 16, 1991, and U.S. Pat. No. 6,006,751, titled Glove for Preventing Carpal Tunnel Syndrome, issued Dec. 28, 1999, described gloves with pad placement such that pressure is diverted away from median nerve of the hand.

U.S. Pat. No. 6,618,860,titled Athletic Gloves for Use when Cycling and Method of Making, issued Sep. 16, 2003, describes athletic gloves having pads on the palms where the pads are adhered to the palms instead of stitched.

One significant issue with these and other padded gloves is ventilation. Often, perforations are provided in portions of the palm. For various structural reasons, conventionally, the perforations are located in areas of the palm not associated with padding. For example, referring to FIG. 1, a palm side 102 of a conventional cycling glove 100 is shown. Palm side 102 has one or more pads 104, 106, 108, and 110 strategically placed for cushioning. Typically, pads 104, 106, 108, and 110 comprise at least one layer of foam surrounded by leather, synthetic leather, or other durable fabric to resist wear. Palm side 102 optionally has texture 112 to aid in grip. Cycling glove 100 may have finger and thumb extensions 114, which are shown terminating in an opening such that the fingers and thumbs are partially exposed or could be extensions that completely envelop the fingers and thumbs such as conventional gloves. Placed between pads 104, 106, 108, and 110 are a plurality of perforations 116 in palm side 102. Perforations 116 may be between pads as shown or elsewhere on palm side 102. Perforations 116 allow air circulation that aids in ventilation of the wearer's hand. Pads 104, 106, 108, and 110 may be separated by air flow channels 118 to allow air flow over perforations 116 to facilitate ventilation.

As can seen, however, cycling glove 100 lacks perforations and/or ventilation where pads 104, 106, 108, and 110 reside. Often the wearer's hand generates a significant portion of heat at those locations because, in part, there is a lack of air circulation. Thus, it would be desirous to provide a cycling glove that had ventilation paths through pads.

SUMMARY OF THE INVENTION

The present invention relates to athletic gloves having a padded insert. The padded insert comprises a reticulated or open-cell foam, or a matrix of rubber material having ventilation pathways.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Referring now to FIGS. 1 to 6, the present invention will be described. The present invention will be described with specific reference to cycling gloves, but one of skill in the art would understand on reading the disclosure that other padded gloves, such as, for example, golfing gloves, batting gloves, and the like, could be substituted for cycling gloves without departing from the scope or spirit of the present invention.

Figure 1:
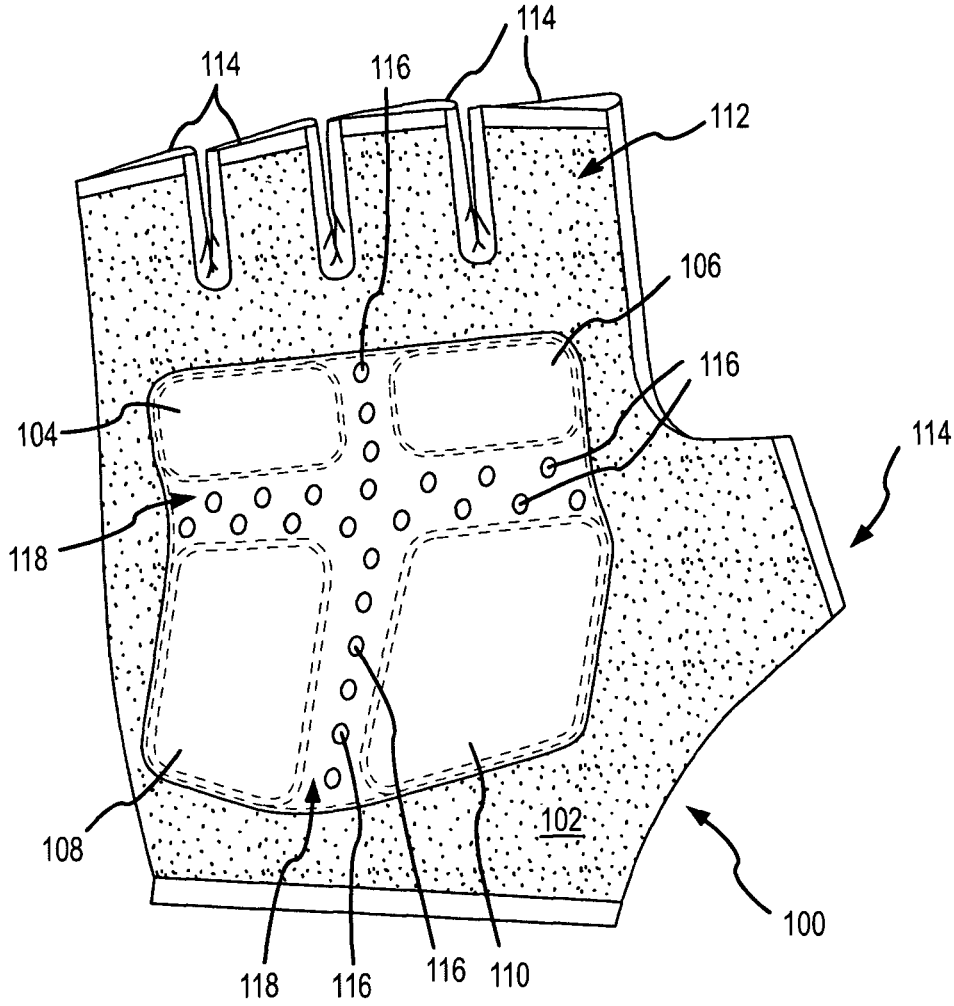
FIG.1 (Prior Art)
FIG. 1 is a palm side elevation view of a conventional cycling glove.

Referring first to FIG. 1, pads 104, 106, 108, and 110 lack ventilation, in part, because of the foam and leather, synthetic leather, or other wear resistant covering (generally referred to hereinafter as "covering"). Conventional foam and covering lack sufficient breathability to provide sufficient air circulation and/or venting. Glove 100 therefore creates "hot spots" on the palm over which the padding resides. Some modicum of ventilation is provided by perforations 116, but glove 100 is typically designed to fit snuggly to the hand of the wearer causing perforations 116 to provide an unsatisfactory solution.

Figure 2:
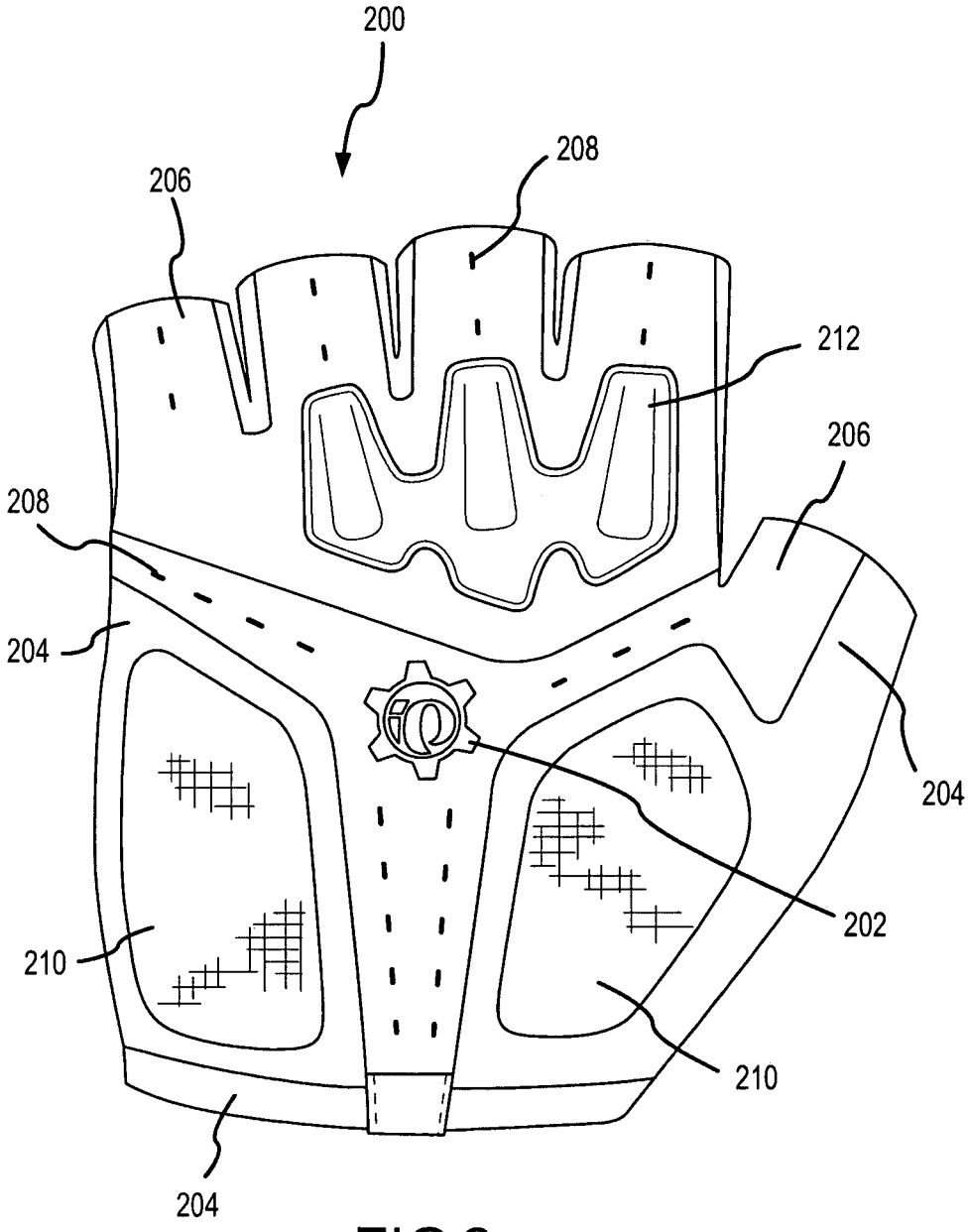
FIG. 2 is a palm side elevation view of a cycling glove consistent with an embodiment of the present invention.

Referring now to FIG. 2, a glove 200 consistent with the present invention is shown. Glove 200 includes a palm 202 with a wear resistant portion 204, such as, for example, leather, synthetic leather, or the like, and finger and thumb extensions 206. Wear resistant portion 204 and extensions 206 include a number of perforations 208 for ventilation. Strategically placed on palm 202 are one or more pad sections 210.

Figure 3:
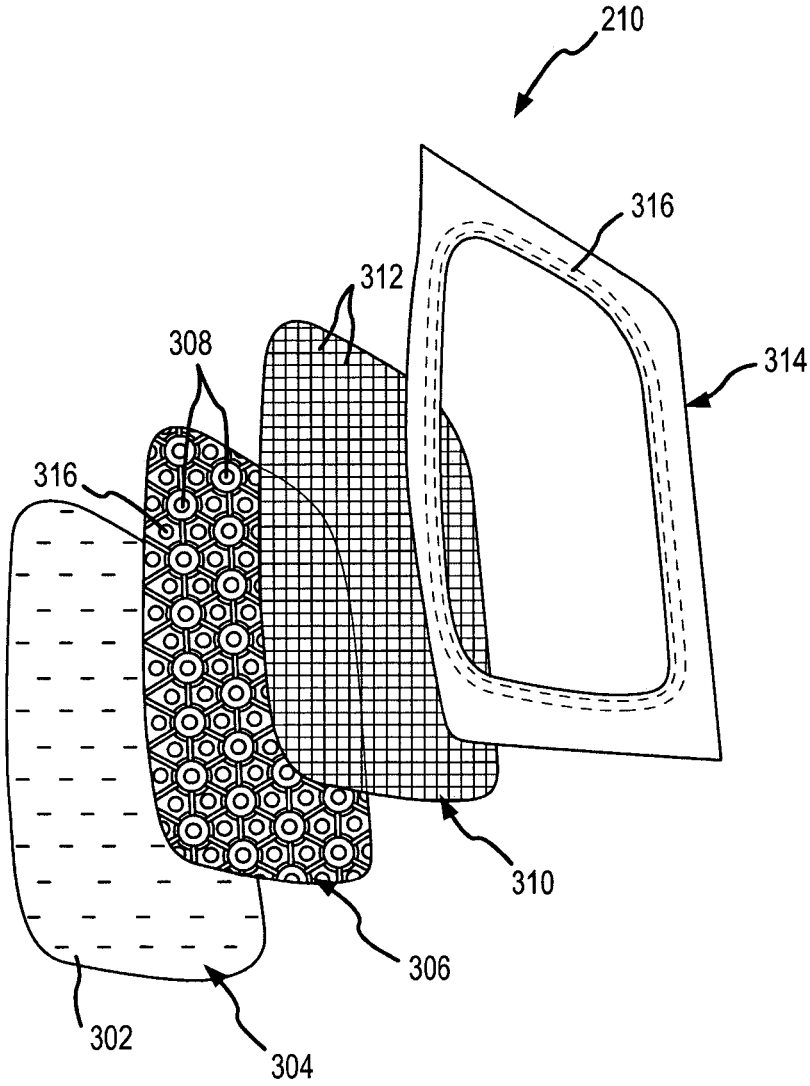
FIG. 3 is an exploded view of a pad section of the cycling glove shown in FIG. 2.

Referring now to FIG. 3, and exploded view of pad section 210 is shown which will be explained in more detail. Pad section 210 includes a base 302 (which would be closer to the wearer's skin) having perforations 304. Base 302 could be the same as wear resistant portion 204 or a separate piece joined to wear resistant portion 204 by thermal welding, adhesives, stitching or other conventional joining devices. A layer of foam 306 is aligned with and resides external to base 302. Foam 306 would have ventilation paths 308 extending through foam 306. Foam 306 could be closed cell foam formed with ventilation paths 308 or be an open cell, reticulated, or other breathable foam that does not require especially formed paths such as, for example, polyurethane foam. Ideally, a majority of ventilation paths 308 align with perforations 304. Foam 306 does not necessarily reside directly on base 302 and other material layers could reside between foam 306 and base 302. Finally, a mesh layer 310 resides external to foam 306. Mesh 310 provides some wear protection to foam 306, but the large mesh loops 312 provide ventilation pathways from perforations 304 through ventilation paths 308 and mesh loops 312. While shown as a large grade mesh, mesh 310 could be other types of breathable fabrics, such as, for example, polyester, nylon, and the like. Substantially surrounding pad section 210 is a boarder 314. Boarder 314 is connected to mesh 310 and base 302 (or wear resistant portion 204). Boarder 314 is connected using a conventional coupling 316. Coupling 316 could be, for example, welding, embossing, stitching, adhesives, or the like.

Foam 306 may have material 316 contained therein. Material 316 may be one or more or anti-microbial materials, wickable materials, absorbent materials, or temperature regulating materials for hygiene management, moisture management and/or temperature management of the wearer.

Figure 4:
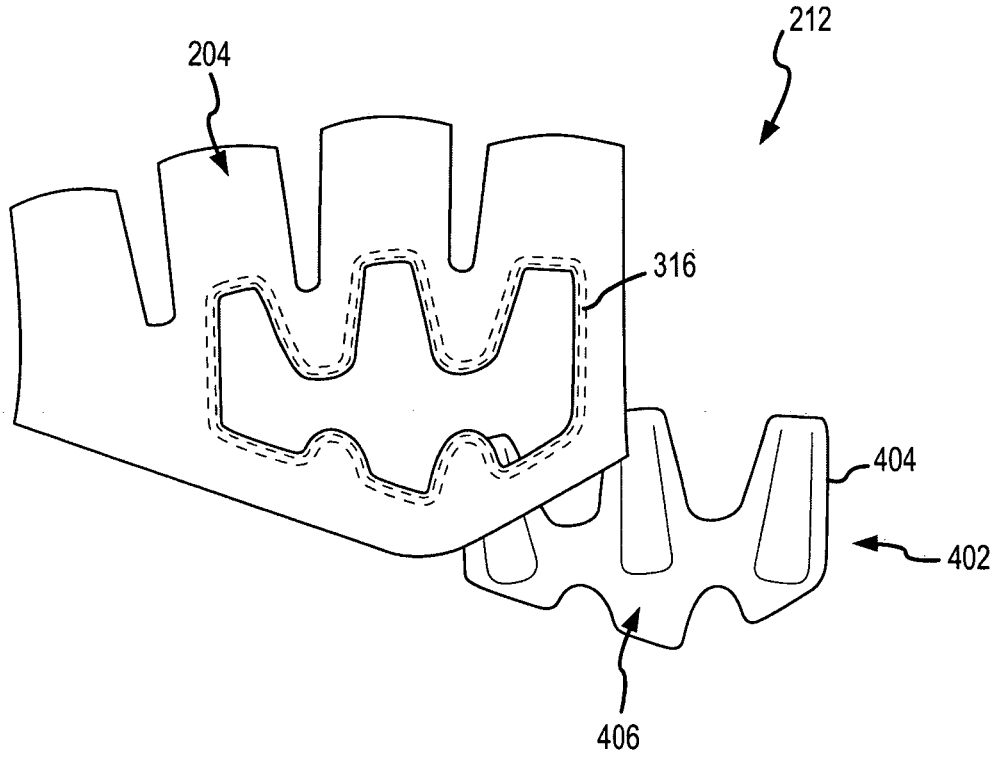
FIG. 4 is an exploded view of an un-vented pad associated with the glove of FIG. 2.

Optionally, wear resistant portion 204 could have surface texture 112 to assist with gripping. Moreover, glove 200 could have un-vented padding portions 212, such as the EVA pad shown. Un-vented padding could use foam similar to vented foam 306 or other foams/gels. Referring to FIG. 4, an exploded view of un-vented padding portion 212 is shown. Padding portion 212 comprises base 402, foam 404, and top layer 406. Base 402 is typically contiguous with wear resistant portion 204, but may be a separate piece coupled to portion 204. Foam 404 may be any conventionally used foam, such as, for example, a moshi foam. Top layer 406 is a durable fabric such as leather or synthetic leather. Top layer 406 could be the same as wear resistant portion 204, but does not need to be the same. Padding 212 is connected to glove 200 using conventional coupling 316.

Figure 5A:
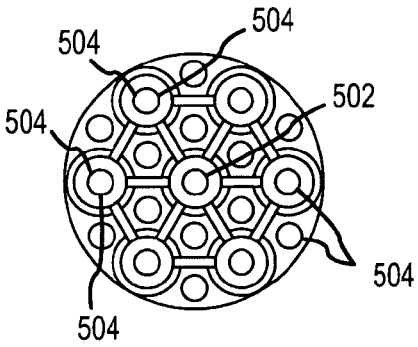
FIGS. 5A-5D are views of another embodiment of a pad section consistent with an embodiment of the present invention.
Figure 5B:
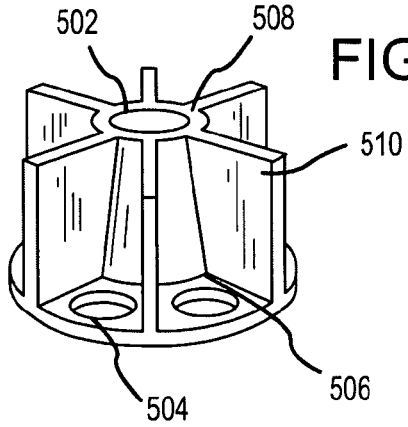
Figure 5C:
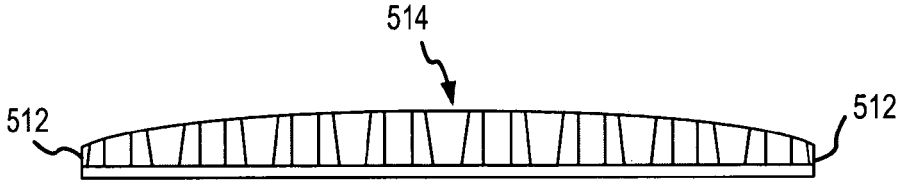
Figure 5D:
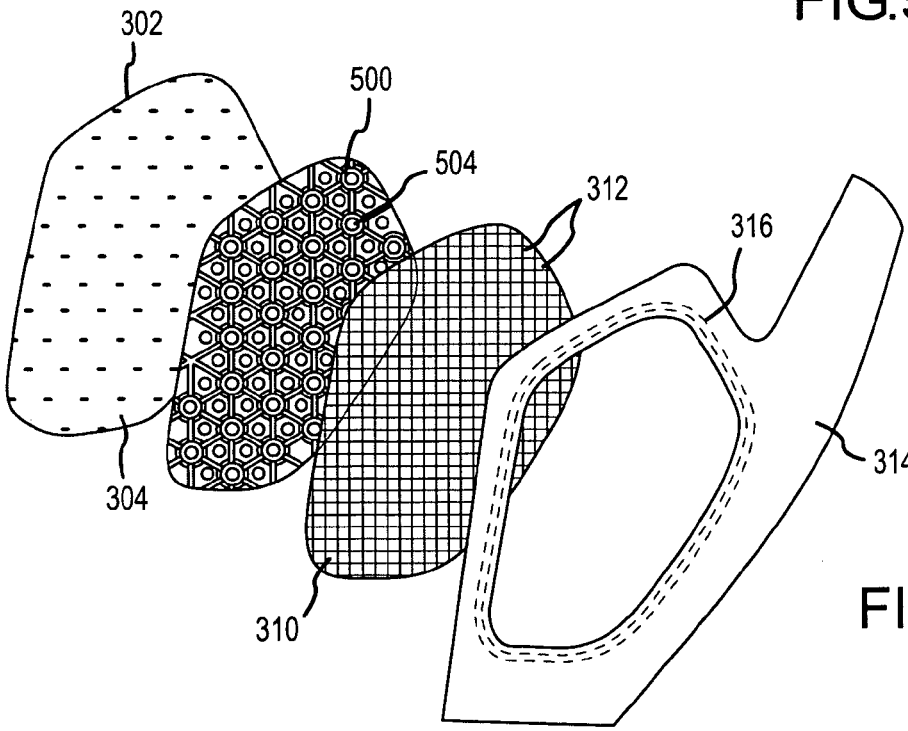

While FIG. 3 is described with reference to foam 306, foam 306 could be replaced with a formed rubber 500, such as, for example, TPR rubber shown in FIGS. 5A-D. FIG. 5A shows a top elevation view of formed rubber 500. Formed rubber 500 is formed into a soft webbing 502 having openings 504. Openings 504 are similar to ventilation paths 308 described above and, ideally, are aligned with perforations 304. Referring to FIG. 5B, a perspective view of webbing 502 and openings 504 is shown. Webbing 502 includes a base 506, a channel support 508, and webbing walls 510. Notice the particular pattern shown in FIGS. 5A-5D is exemplary and should not be considered limiting. Referring now to FIG. 5C, it is believed formed rubber 500 should have a domed shaped such that ends 512 are shorter than a central portion 514. Finally, FIG. 5D shows an exploded view of pad 210 with formed rubber 500 instead of foam 306.

Figure 6:
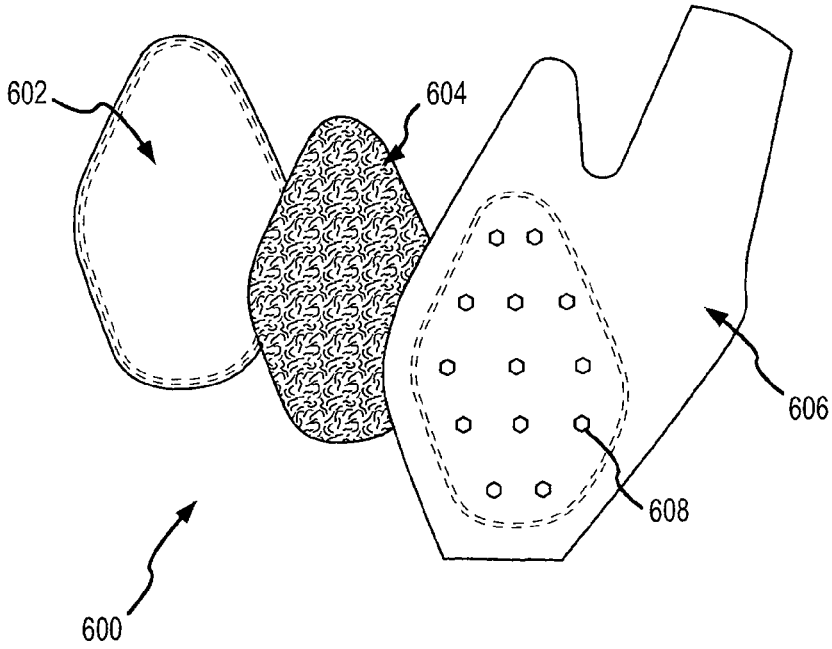
FIG. 6 is a view of still another embodiment of a pad section consistent with an embodiment of the present invention.
Figure 6A:
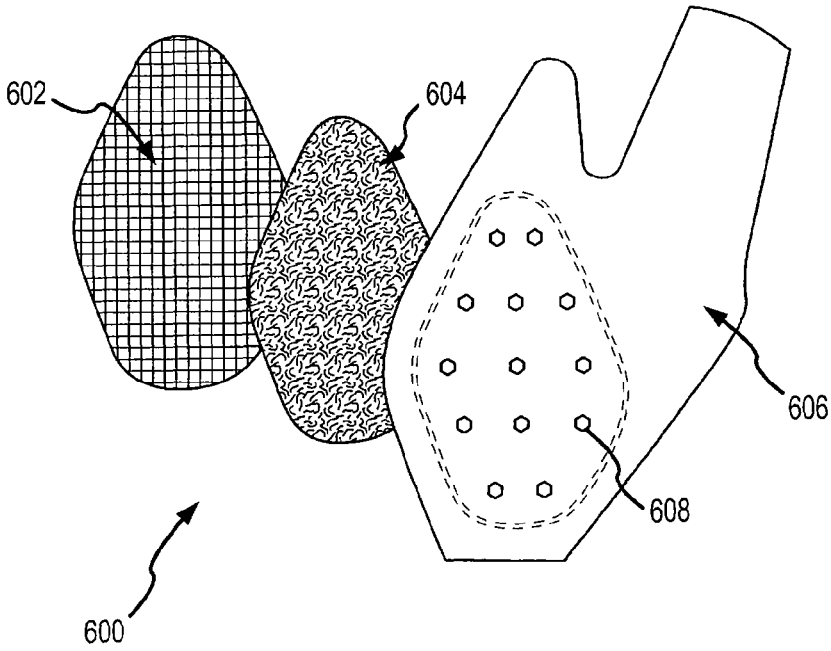
FIG. 6A is an exploded perspective view of an another embodiment of the pad section shown in FIG. 6, showing the base layer as a mesh.

Referring now to FIGS. 6 and 6A, another example of a padding section 600 is depicted. Padding section 600 could replace or be used in conjunction with padding section 210, see FIG. 2. Padding section 600 comprises a base 602, an insert 604, and a non-breathable wear resistant top layer 606 with a plurality of perforations 608. Base 602 is shown in FIGS. 6 and 6A as a breathable fabric or liner, such as, for example, polyester, nylon, or the like, or as a mesh. However, base 602 could comprise perforated non-breathable material similar to base 302 described above (Moreover, base 302 could be replaced with base 602). Insert 604 could be a foam, such as, close cell foam with openings 308, open cell foam or reticulated foam, such as foam 306, or insert 604 could be a formed rubber 500, such as TPR rubber shown in FIG. 5. Top layer 606 is a non-breathable material, such as, for example, leather, synthetic leather, or the like.

Generally, when formed rubber 500 is used for the breathable padding construction, mesh 310 is used to provide increased ventilation because formed rubber 500 is, itself, relatively durable. However, when open cell or reticulated foam 306 is used for the breathable padding, top layer 606 with perforations 608 is used as the reticulated and/or open cell foam is less durable and/or wear resistant. Structure 600 is similarly surrounded by boarder 314 to connect alternative padding to the glove. Boarder 314 is connected to the glove using conventional coupling 316.

While the invention has been particularly shown and described with reference to embodiments thereof, it will be understood by those skilled in the art that various other changes in the form and details may be made without departing from the spirit and scope of the invention.

We claim:

1. A padding section for a glove, the padding section comprising:

a base material positioned within at least a portion of a palm side of the glove and configured to allow airflow through the base material;

a non-perforated insert substantially aligned with the base material, the insert comprising at least one of reticulated or open foam;

a layer of material substantially aligned with the base material and configured to allow airflow through the layer;

the base material positioned closest to a user's hand when wearing the glove;

the non-perforated insert located substantially between the base material and the layer;

the base material, the insert, and the layer defining at least one ventilation path the palm side of the glove; and the at least one ventilation path being coextensive with and extending from a palm facing side of the base material to a palm facing side of the insert through a portion of the base material located on the palm side of the glove, from the palm facing side of the insert to a palm facing side of the layer through a portion of the insert located on the palm facing side of the glove, and from the palm facing side of the layer to an external environment facing side of the layer through a portion of the layer located on the palm side of the glove, such that at least a portion of a palm side of the user's hand is vented through the padding section, wherein the layer comprises a breathable material.

2. The athletic glove according to claim 1, wherein the breathable material comprises mesh.

3. An athletic glove, comprising:

a palm section to substantially align with a palm of a user; and a plurality of extensions associated with the palm section;

the palm section comprising at least one vented pad section; and the at least one vented pad section connected to the palm section by a coupling;

the at least one vented pad section comprising:

a base material positioned within at least a portion of the palm section of the glove and configured to allow airflow through the base material;

a non-perforated foam layer wherein the foam layer is comprises at least one of a reticulated foam and an open cell foam; and a layer of material substantially aligned with the base material and configured to allow airflow through the layer;

the base material positioned closest to the user's hand when wearing the glove;

the non-perforated foam layer located substantially between the base material and the layer;

the base material, the non-perforated foam layer, and the layer defining at least one ventilation path located on the palm side of the glove; and the at least one ventilation path being coextensive with and extending from a palm facing side of the base material to a palm facing side of the non-perforated foam layer through a portion of the base material located on the palm side of the glove, from the palm facing side of the non-perforated foam layer to a palm facing side of the layer through a portion of the non-perforated foam layer located on the palm side of the glove, and from the palm facing side of the layer to an external environment facing side of the layer through a portion of the layer located on the palm side of the glove to vent the palm of the user through the at least one vented pad section, wherein the layer comprises a breathable material.

4. An athletic glove, comprising:

a palm section to substantially align with a palm of a user; and a plurality of extensions associated with the palm section;

the palm section comprising at least one vented pad section; and the at least one vented pad section connected to the palm section by a coupling;

the at least one vented pad section comprising:

a base material positioned within at least a portion of the palm section of the glove and configured to allow airflow through the base material;

a non-perforated formed rubber layer wherein the formed rubber defines a plurality of ventilation pathways; and a layer of material substantially aligned with the base material and configured to allow airflow through the layer;

the base material positioned closest to the user's hand when wearing the glove;

the formed rubber layer located substantially between the base material and the layer;

the base material, the non-perforated formed rubber layer, and the layer defining at least one ventilation path located on the palm side of the glove; and the at least one ventilation path being coextensive with and extending from a palm facing side of the base material to a palm facing side of the non-perforated formed rubber layer through a portion of the base material located on the palm side of the glove, from the palm facing side of the non-perforated formed rubber layer to a palm facing side of the layer through a portion of the non-perforated formed rubber layer located on the palm side of the glove, and from the palm facing side of the layer to an external environment facing side of the layer through a portion of the layer located on the palm side of the glove to vent the palm of the user through the at least one vented pad section, wherein the layer comprises a breathable material.

5. The athletic glove according to claim 4, wherein the breathable material comprises a mesh.

* * * * *